US006543750B1

(12) United States Patent
Calzone

(10) Patent No.: US 6,543,750 B1
(45) Date of Patent: Apr. 8, 2003

(54) PROTECTIVE CAP FOR THE TOP OF METAL FENCE POSTS

(76) Inventor: Ronald J. Calzone, HCR 60 Box 296, Dixon, MO (US) 65459

( * ) Notice: Subject to any disclaimer, the term of this patent is extended or adjusted under 35 U.S.C. 154(b) by 0 days.

(21) Appl. No.: 10/007,241

(22) Filed: Nov. 13, 2001

Related U.S. Application Data

(60) Provisional application No. 60/253,807, filed on Nov. 29, 2000.

(51) Int. Cl.[7] ..... E04H 14/10
(52) U.S. Cl. ..... 256/1; 256/19
(58) Field of Search ..... 256/10–19

(56) References Cited

U.S. PATENT DOCUMENTS

| | | | | |
|---|---|---|---|---|
| 3,267,805 A | | 8/1966 | Ackerman | |
| 4,516,756 A | | 5/1985 | Beatty | |
| 4,520,231 A | | 5/1985 | Hubbell | |
| 4,623,756 A | | 11/1986 | Wilson, Jr. | |
| 4,680,428 A | * | 7/1987 | Wilson, Jr. | 256/10 X |
| 5,085,409 A | | 2/1992 | Teixeira | |
| 5,731,895 A | | 3/1998 | Owczarzak et al. | |
| 5,755,431 A | * | 5/1998 | Williams | 256/19 |
| 5,956,875 A | | 9/1999 | Aughenbaugh | |
| 6,330,998 B1 | * | 12/2001 | Roy | 256/19 |

* cited by examiner

*Primary Examiner*—Lynne H. Browne
*Assistant Examiner*—John R. Cottingham
(74) *Attorney, Agent, or Firm*—Greensfelder, Hemker & Gale, P.C.

(57) ABSTRACT

A protective cover is provided that lessens the potential for injury to people or livestock from the sharp edges of steel T-posts typically used in fencing. It has a T-shaped cross-section configuration approximating the shape of a fence post, and has a longitudinal channel for receiving one or more of the projecting studs on the front of the fence post. The instant invention is economical to produce, easy to install and flexible in application in order to accommodate a large range of T-post sizes. Installed on a fence post, it provides a blunt, soft buffer between the sharp edge of the post and any animal that comes in contact with the end.

9 Claims, 4 Drawing Sheets

PROTECTIVE CAP FOR THE TOP OF METAL FENCE POSTS

RELATED APPLICATION

This application claims the priority benefit of U.S. Provisional Application No. 60/253,807, filed Nov. 29, 2000.

BACKGROUND OF THE INVENTION

Certain livestock containment fences can be problematic with respect to the safety of any animals which might come in close contact with the fence, especially horses. Livestock will sometimes be crowded into a fence by other animals; they sometimes come into contact as they pace along a fence line; they sometimes are chased into a fence or otherwise run into a fence.

One of the most economical types of fence incorporates steel fence posts with a "T" cross section and strands of wire or other material spanning the posts. Alternatives to barbed wire lessens the likelihood that the animals will be injured by the wire, but the steel fence posts are still a potential source of injury.

Steel fence posts are usually manufactured by extrusion or rolling and then sheared to length. The shearing process almost always leaves a sharp edge or burr on the top of the post. This sharp edge is the source of many steel fence post induced injuries. Injuries range from small scratches or cuts to deep lacerations to impalement. Sometimes the injuries result in lessened utility, either temporarily or permanently, and at times total loss due to the death of the animal.

Common injuries include lacerations around the head and neck as the animal paces along the length of the fence, sometimes with its head hanging over the fence. More serious injuries often result from the animal running into and over the fence, causing the post to bend. As the animal passes over the post, the sharp end of the post lacerates the under side of the animal. At times the animal may stop before continuing completely over the fence and then attempt to back up. The bent post could then impale the animal. Another mode of injury occurs when a horse rears over and falls onto a post which may cause serious laceration or impalement.

Existing art intended to protect livestock from injury from steel fence posts are problematic in two general areas: The design is inherently costly to produce, especially when the large number of posts in most livestock operations is considered. Existing art is also prone to being pushed off the end of the post when an animal runs into and bends over the post; the sharp end of the post is then left exposed.

Other devices applied to the end of steel fence posts are not designed to protect livestock. They are not sufficiently soft or blunt enough to provide protection in a broad range of scenarios.

SUMMARY OF THE INVENTION

The invention comprises a protective cover, or cap, for the top of metal fence posts. The cap has a T-shaped cross section approximating that of the cross section of the fence post. The cap is comprised of flexible plastic, and is pliable for ease in sliding over the top of the fence post. Because the cap has a T-shape cross-section similar to the fence post, it will maintain a snug fit on the top of the post. A channel is featured on the front side of the cap to accommodate the stud-like protrusions on the front of the fence post upon which the wire strands of the fence are supported. The channel is open at the bottom of the cap to allow it to easily slide over the top of the post without obstruction from the post protrusions. The sides of the cap have a tapered thickness, being thicker at the top of the cap and thinner at the bottom. This feature provides advantages in that the increased thickness at the top of the cap provides significant protection from the relatively sharp edges of the top of the post, while the decreased thickness at the bottom presents less of an edge for an animal's body to catch to dislodge the cap from the post. The cap's design and material composition makes it easy to install and remove, and is relatively cheap, which makes it cost effective to place the caps on each post along a fence line. If the cap becomes worn or damaged, it is readily replaceable.

It is therefore an object of the invention to provide a safety cap for a metal fence post that is capable of providing protection against injury to the animal from the sharp edges of the post. It is also an object of the invention to provide a safety cap which is easy to install on and remove from a fence post. It is still further an object of the invention to provide a safety cap that is economical in both structure and material to make maintenance of an entire fence line with the safety caps cost effective.

These and other object of the present invention are realized in the preferred embodiment of the present invention, described by way of example and not by way of limitation. Additional object, advantages and novel features of the present invention will be set forth in the description which follows, and will become apparent to those skilled in the art upon examination of the following more detailed description and drawings in which like elements of the invention are similarly numbered throughout.

DESCRIPTION OF THE INVENTION

Figure 1:
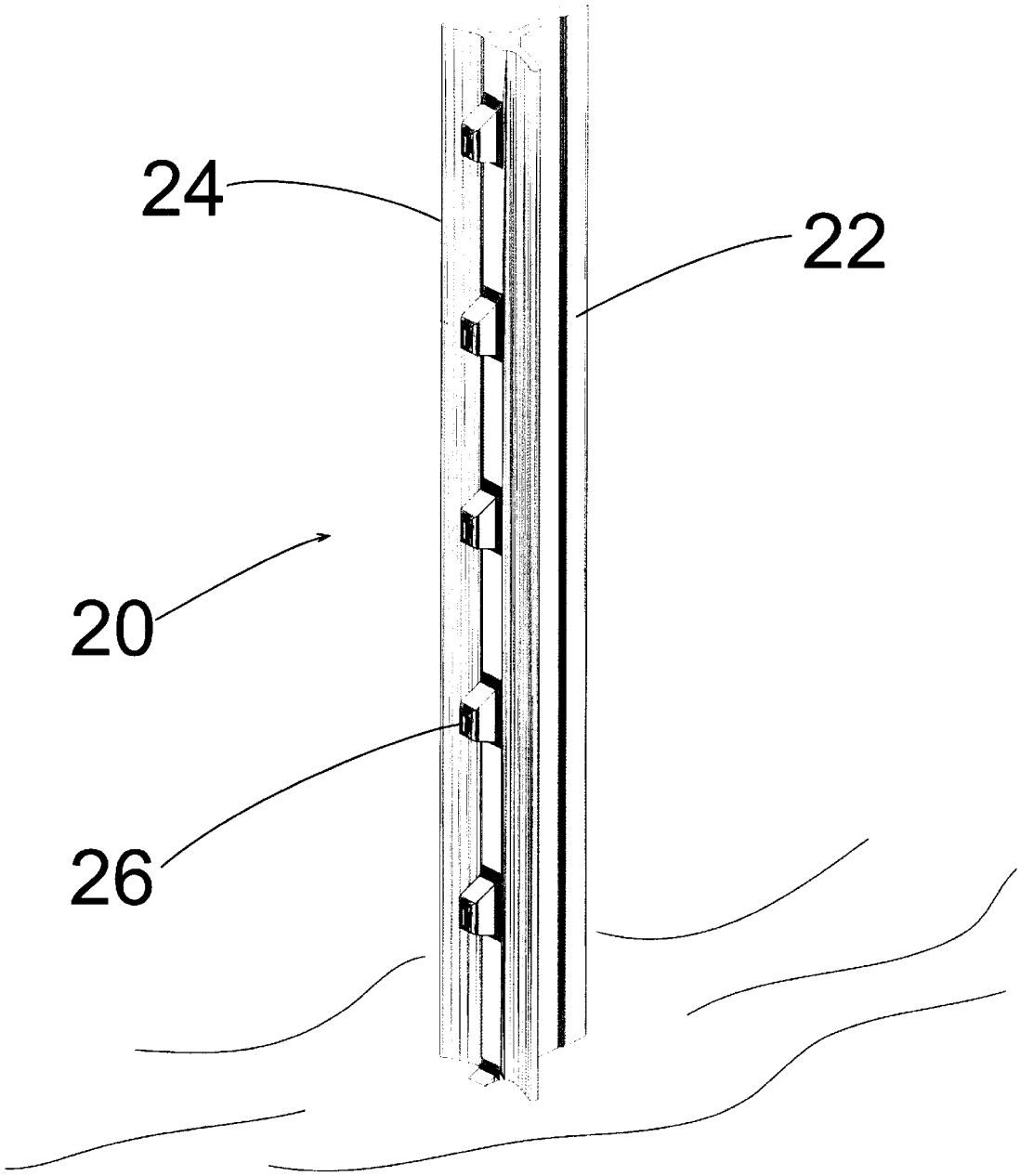
FIG. 1 is a perspective view of a typical unprotected steel fence post.

A typical metal fence post to which this invention relates is shown in FIG. 1 and is generally indicated by the reference numeral 20. It is comprised of an elongated shaft 22 having laterally extending flanges 24. A series of protruding studs 26 extend along the front surface of the fence post. The precise location of these studs 26 along any particular post is somewhat random, as the manufacturing process of metal fence posts allows for relatively loose tolerance. Therefore, a first stud may be positioned directly at the top edge of the post, it may be spaced apart from the top edge (as shown in FIG. 1), or only a partial stud may be present at the top of the post, all depending upon the point at which the post is cut during the manufacturing process, as is understood by those having skill in the art.

Figure 2:
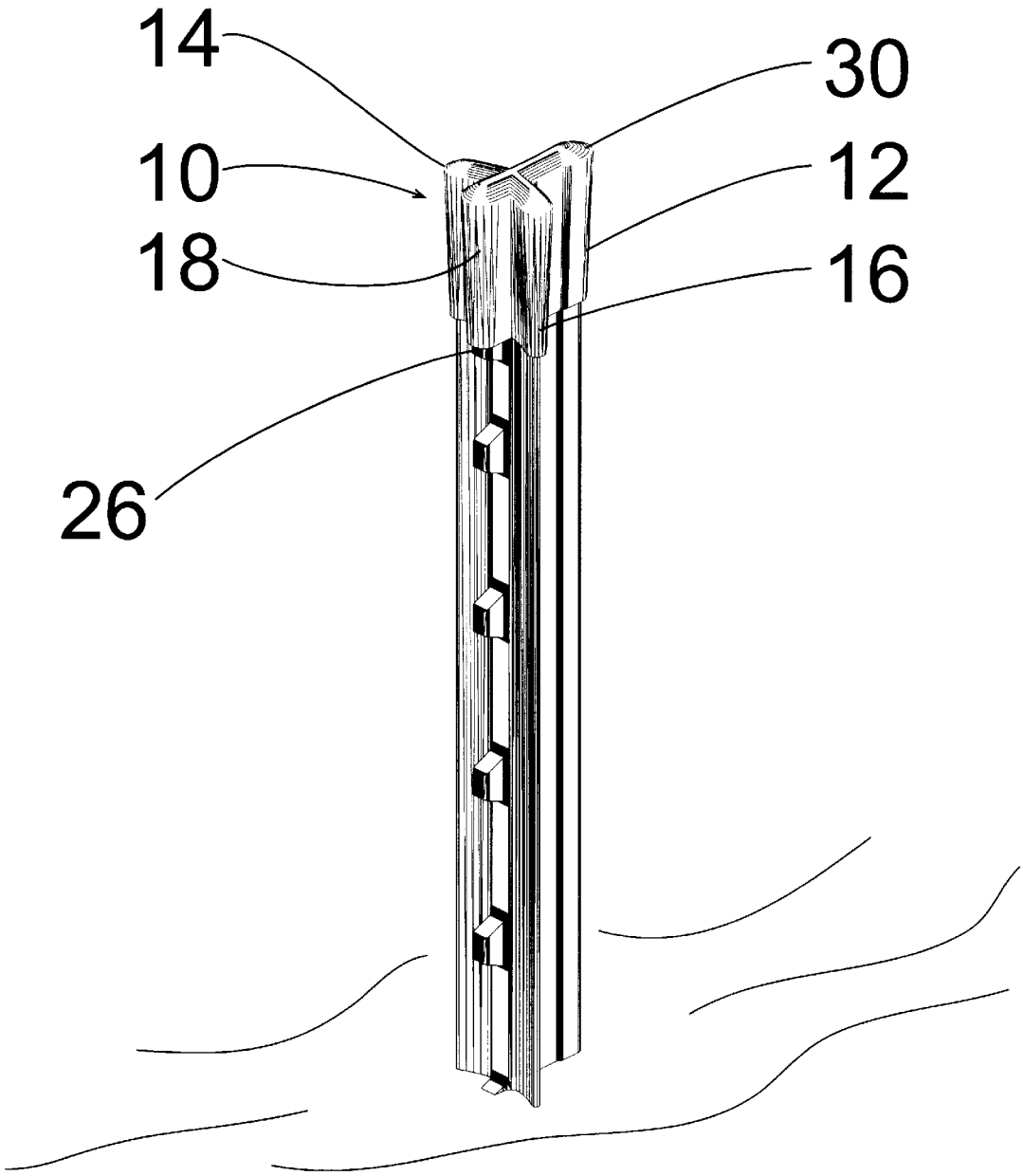
FIG. 2 is a perspective view of a post with a protective cap installed.
Figure 3:
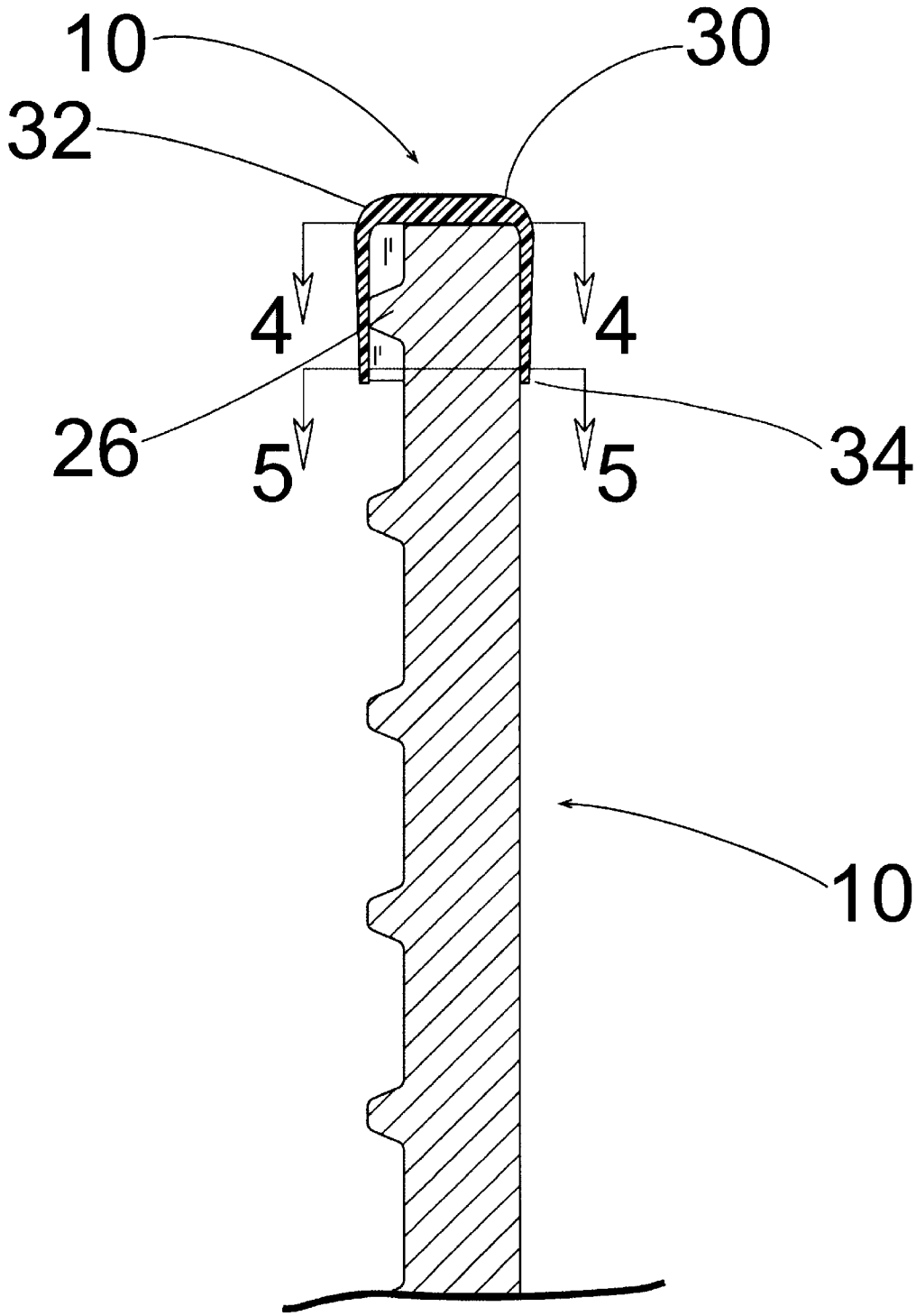
FIG. 3 is a cross-sectional view in side elevation of the post with the protective cap installed.
Figure 4:
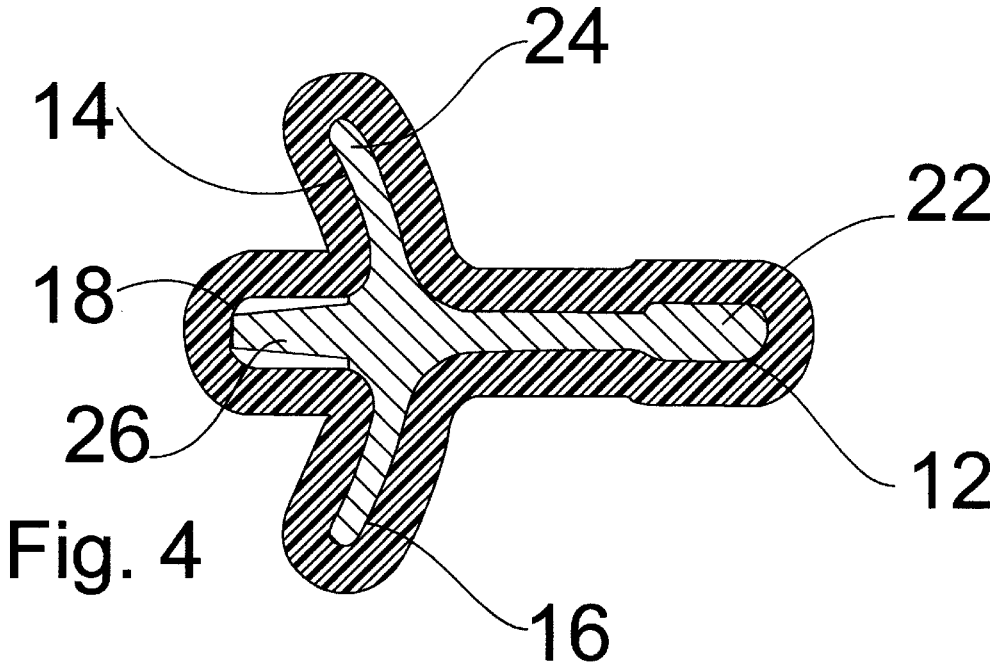
FIG. 4 is a cross-sectional view of the fence post and cap taken along the lines 4—4 in FIG. 3.
Figure 5:
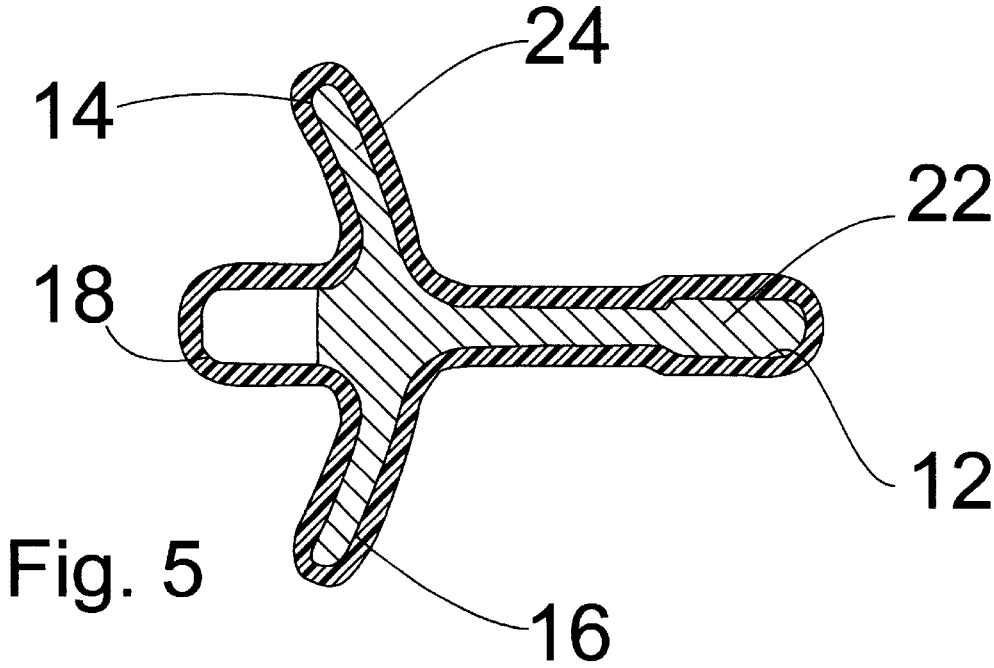
FIG. 5 is a cross-sectional view of the fence post and cap taken along the lines 5—5 in FIG. 3.

The protective cap of the present invention is generally indicated by the reference numeral 10 and is shown in FIG. 2. It is placed over and fits on the top end of the fence post. It has a lateral cross-sectional shape approximating that of the fence post as shown in FIGS. 3–5, and comprises a shaft receiving channel 12, lateral flange receiving channels 14 and 16, and stud-receiving channel 18. Cap 10 should be at least two to three inches long to sufficiently cover the top end of the fence post and to extend to a depth sufficient to provide an adequate retaining grip on the post to prevent inadvertent dislodgment therefrom. Each of the shaft receiving channel 12, flange receiving channels 14 and 16, and stud-receiving channel 18 extend the full length of the cap and form an opening at the cap's bottom edge. Because of the imprecise manufacture of fence posts, the placement of studs along the length at the top of the post will vary from post to post. Because receiving channel 18 extends the full length of the cap, any variation in the positioning of post studs 26 at the top of the post will be accommodated within the channel. In certain situations where the cap does not reach down along the length of the post to completely cover a stud as shown in FIG. 2, the channel will nonetheless allow partial coverage of the stud with a portion of the stud extending from the bottom opening of the channel and still retain a snug fit. It is important that the cap not be easily dislodged by an animal; however, the cap must nonetheless be able to be removed for repair and replacement. The fully extending channel 18 will permit the cap to be pulled off the post without hindrance by the front studs.

Although flexible, the protective cap is tough and thickened in certain areas to inhibit the penetration of the sharp fence post through the cap. The blunt, rounded corners 30 further inhibit injury to livestock coming in contact with the post. Cap 10 also has a slightly tapered configuration, having a thicker wall 32 at its top and upper sides, decreasing in width to a thinner wall 34 along its lower sides. The difference in wall thicknesses, which gives rise to the tapered effect, is shown in the cross-sectional views in FIGS. 4 and 5. As an example, the upper wall thickness may be between 0.0130 to 0.150 inches and the lower wall thickness may be between 0.040 to 0.070 inches. Preferably, the upper wall thickness is around 0.135 to 0.140 inches and the lower wall thickness is around 0.065 inches. It will be understood by those having ordinary skill in the art that other thickness could be suitable as well. As shown in FIG. 3, the tapered configuration presents a less pronounced lower edge profile against the post. This thin edge lessens the problems associated with a broader and blunter lower edge, against which an animal may contact thus increasing the chances for dislodgment of the cap from the post. The tapered nature of the protective cap therefore inhibits the "stripping" effect in the event an animal rubs against the post.

The elastic protective cap of the instant invention is most effectively composed of flexible plastic, such as polyvinyl plastisol, and is easily manufactured by processes such as dip molding or by other methods well known to those skilled in the art. The same mechanical properties that permit flexibility of installation provide a safe cushion in the event of contact by livestock. The elastic nature of the material also secures the protective cap to the post without further fasteners.

Although the protective cap of this invention is directed primarily to protecting livestock from being injured by the tips of metal fence posts, it is certainly useful in protecting against human injury as well. Metal fence posts are used in a number of other situations besides livestock fences, such as barrier fences used in crowd control. The protective cap is readily applied to metal fence posts as used in practically every environment.

Various changes and modifications may be made within this invention as will be apparent to those skilled in the art. Such changes and modifications are within the scope and teaching of this invention as described herein.

What is claimed is:

1. A protective cap for the top of a metal fence post, said post being of a type comprised of an elongated shaft member having laterally extending flanges, with a series of protruding studs spaced vertically along a front surface of said post, an exterior surface of said cap having a T-shape lateral cross-section approximating that of a cross-section of said post, said cap being comprised of a shaft receiving channel, lateral flange receiving channels and a stud receiving channel, said cap being open at a bottom end thereof for receiving said top of said metal fence post, each of said shaft receiving channel, lateral flange receiving channels and stud receiving channel being open at said bottom end and extending along a substantial length of said cap, said cap being adapted for installation and removal on said post by sliding thereon, said stud receiving channel permitting said protruding studs on said post to pass unobstructed along said stud receiving channel within said cap.

2. The protective cap of claim 1 in which side walls of said cap have a tapered thickness such that a thickness of said side wall at a bottom edge of said cap is less than a thickness of said side wall towards a top of said cap, whereby a profile of said bottom edge of said cap against said post is minimized.

3. The protective cap of claim 2 in which said wall thickness at said bottom edge of said cap is between around 0.040 to 0.060 inches, and said wall thickness along said top area of said cap is between around 0.130 to 0.150 inches.

4. The protective cap of claim 3 in which said wall thickness at said bottom edge of said cap is around 0.065 inches, and said wall thickness along said top area of said cap is between around 0.135 to 0.140 inches.

5. The protective cap of claim 1 in which comer edges at a top of said cap are rounded.

6. The protective cap of claim 1 in which a top area of said cap has a thickened wall to prevent said top of said metal fence post from penetrating through said cap upon impact from an external force.

7. The protective cap of claim 1 in which said cap is formed from flexible plastic.

8. The protective cap of claim 7 in which said plastic is polyvinyl plastisol.

9. The protective cap of claim 1 in which sides of said cap have a tapered wall thickness such that a thickness of said wall at a bottom edge of said cap is less than a thickness of said wall along a top area of said cap, whereby a profile of said bottom edge of said cap against said post is minimized, corner edges at a top of said cap being rounded, and said cap being formed from flexible plastic.

* * * * *

UNITED STATES PATENT AND TRADEMARK OFFICE

CERTIFICATE OF CORRECTION

PATENT NO. : 6,543,750 B1
DATED : April 8, 2003
INVENTOR(S) : Calzone, Ronald J.

It is certified that error appears in the above-identified patent and that said Letters Patent is hereby corrected as shown below:

Column 4,
Line 41, “comer” should be -- corner --.

Signed and Sealed this

Eleventh Day of November, 2003

JAMES E. ROGAN
*Director of the United States Patent and Trademark Office*